US006949000B1

(12) United States Patent
Antoine

(10) Patent No.: US 6,949,000 B1
(45) Date of Patent: Sep. 27, 2005

(54) WHEELED PUSH TOY

(76) Inventor: Stanford Antoine, 312 Esat 93rd St. #1R, Brooklyn, NY (US) 16442

( * ) Notice: Subject to any disclaimer, the term of this patent is extended or adjusted under 35 U.S.C. 154(b) by 0 days.

(21) Appl. No.: 10/888,775

(22) Filed: Jul. 9, 2004

(51) Int. Cl.[7] ..... A63H 1/00; A63H 3/02; A63H 17/36

(52) U.S. Cl. ..... 446/237; 446/450; 446/468

(58) Field of Search ..... 446/450, 451, 446/411, 412, 468, 238, 237; 280/47.131, 280/47.17, 93.504, 93.505

(56) References Cited

U.S. PATENT DOCUMENTS

| | | | | |
|---|---|---|---|---|
| 1,142,214 | A * | 6/1915 | Williams | 446/237 |
| 1,583,567 | A * | 5/1926 | Becker | 446/237 |
| 2,647,343 | A * | 8/1953 | Zileri et al. | 446/450 |
| 2,730,837 | A | 1/1956 | Vaughan | |
| 3,762,096 | A | 10/1973 | Reyes | |
| 3,940,881 | A | 3/1976 | Drucker | |
| 4,016,675 | A * | 4/1977 | Drucker | 446/451 |
| 4,030,243 | A * | 6/1977 | Drucker | 446/139 |
| 4,317,307 | A | 3/1982 | Conry | |
| 4,765,636 | A | 8/1988 | Speer | |
| 5,240,451 | A | 8/1993 | Clark, Jr. | |
| 5,288,258 | A | 2/1994 | Soso | |
| 5,288,262 | A * | 2/1994 | Phillips | 446/451 |
| 6,272,946 | B1 | 8/2001 | Roux | |

* cited by examiner

*Primary Examiner*—Derris H. Banks
*Assistant Examiner*—Faye Francis
(74) *Attorney, Agent, or Firm*—Goldstein Law Offices, P.C.

(57) ABSTRACT

A push toy for providing children with hours of fun-filled amusement, having a pair of wheels, a steering wheel, and a steering mechanism for moving the push toy in one direction or the other. The steering mechanism has a reel, a pin, and a thread. The steering wheel is rotatably connected with the reel about the pin whereby rotation of the steering wheel causes the reel to pull the thread in one direction or the other, causing the push toy to rotate relative to the steering wheel and thereby redirect the direction of the wheels with precision.

7 Claims, 3 Drawing Sheets

WHEELED PUSH TOY

BACKGROUND OF THE INVENTION

The invention relates to a toy, and more particularly, to a wheeled push toy for providing children with hours of fun-filled amusement.

Toys and games have been around as long as children have been around. While the materials and technology many have changed over the years, the toys of today are very much like those with which ancient children played: dolls, hoops, handmade animals, little weapons, vehicles, and boats have been favored items for play for many generations. While toy fads come and go, some toys remain timeless classics. Simplistic in design and appealing to a wide age range, traditional-type toys are the ones that children play with over and over, long after this season's new hot item is consigned to the bottom of the toy chest.

U.S. Pat. No. 5,288,258 to Soso discloses a wheeled toy. U.S. Pat. No. 3,940,881 to Drucker discloses a push toy having an electromagnetic bumper. U.S. Pat. No. 6,272,946 to Roux discloses a steering vehicle for a miniature vehicle. U.S. Pat. No. 5,240,451 to Clark discloses a steerable toy vehicle. U.S. Pat. No. 4,765,636 to Speer discloses a steerable wheeled pushcart having an improved steering mechanism. U.S. Pat. No. 4,317,307 to Conry discloses a walk behind, steerable wheeled toy having a mounted steering column. U.S. Pat. No. 3,762,096 to Reyes discloses a string controlled toy vehicle. U.S. Pat. No. 2,730,837 to Vaughan discloses a toy mechanism for controlling a toy.

While these units may be suitable for the particular purpose employed, or for general use, they would not be as suitable for the purposes of the present invention as disclosed hereafter.

SUMMARY OF THE INVENTION

It is an object of the invention to produce a push toy for providing children with hours of fun-filled amusement. Accordingly, the push toy of the invention has an axel having opposite ends and a pair of wheels rotatably mounted to the opposite ends of the axel for moving the push toy in one direction or the other and thereby providing children with hours of fun-filled amusement.

It is another object of the invention to provide a push toy that is capable of being easy propelled by a child. Accordingly, the invention has a steering wheel for controlling the direction of the push toy for easy use by a child.

It is another object of the invention to provide a push toy that turns corners with precision and thereby sharpens hand-eye coordination of a child. Accordingly, the steering mechanism has a reel, a pin, and a thread. The steering wheel is rotatable connected with the reel about the pin whereby rotation of the steering wheel effectively causes the reel to pull the thread in one direction or the other, causing the push toy to rotate relative to the steering wheel and thereby redirect the direction of the wheels with precision for sharpening hand-eye coordination.

This invention is a push toy for providing children with hours of fun-filled amusement, having a pair of wheels, a steering wheel, and a steering mechanism for moving the push toy in one direction or the other. The steering mechanism has a reel, a pin, and a thread. The steering wheel is rotatably connected with the reel about the pin whereby rotation of the steering wheel causes the reel to pull the thread in one direction or the other, causing the push toy to rotate relative to the steering wheel and thereby redirect the direction of the wheels with precision.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
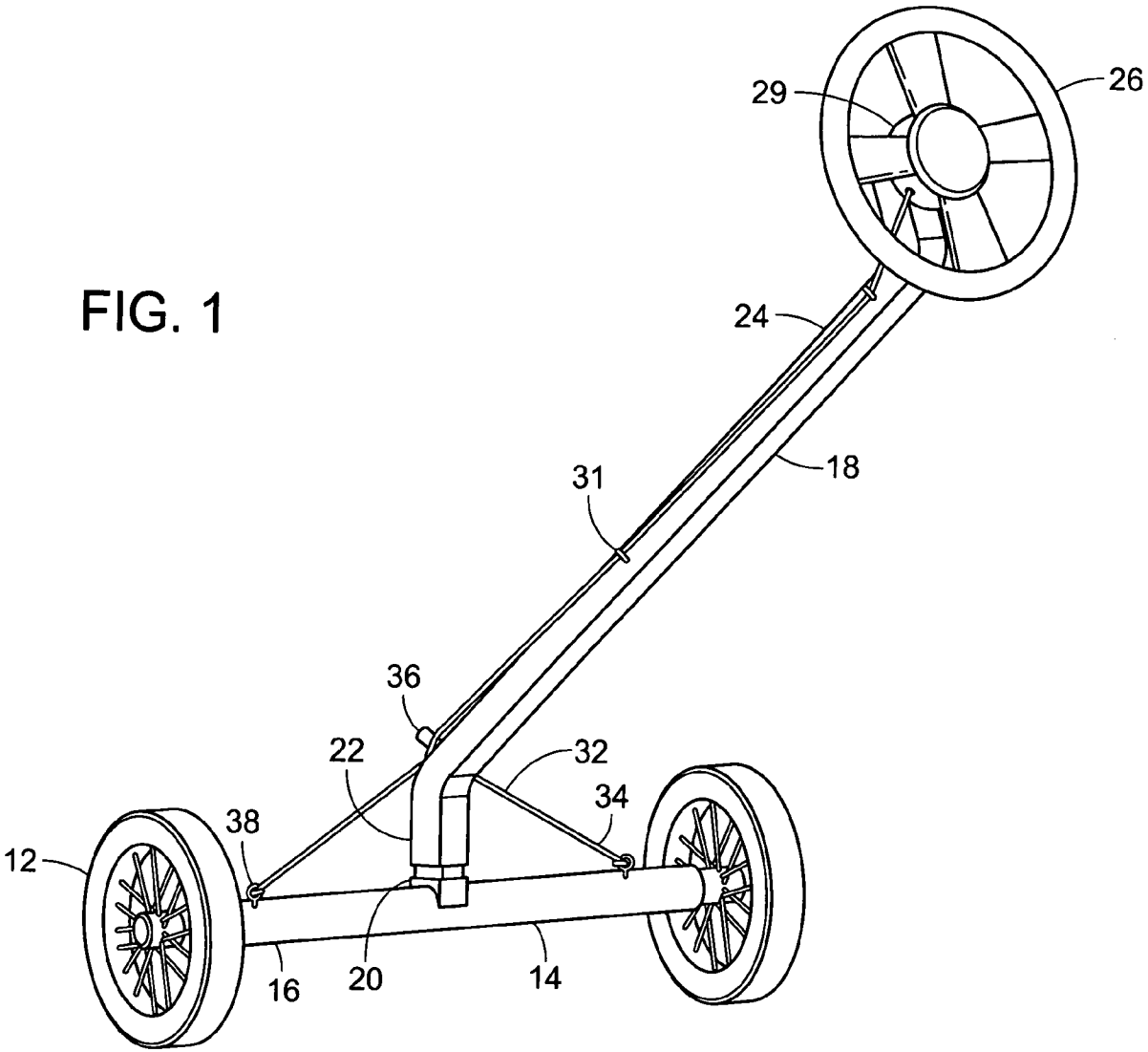
FIG. 1 is a diagrammatic perspective view of the push toy of the present invention having a pair of wheels, an axel, a bar, and a steering wheel.

FIG. 1 illustrates a push toy 10 of the present invention for providing children with hours of fun-filled amusement. The push toy 10 is preferably appropriate for children ages three to twelve and is controlled by pushing and steering. The push toy 10 has a pair of wheels 12, which are each preferably rubber. The push toy 10 has an axel 14 having opposite ends 16, a bar 18, and a pivoting joint 20. The wheels 12 are rotatably mounted on the opposite ends 16 of the axel 14 for moving the push toy 10 in one direction or the other. The pivoting joint 20 is centrally located on the axel 14 extending upwardly therefrom. The bar 18 is an elongated hollow member having a bottom end 22 and a top end 24. The pivoting joint 20 slides within the hollow bottom end of the bar 18.

Figure 2:
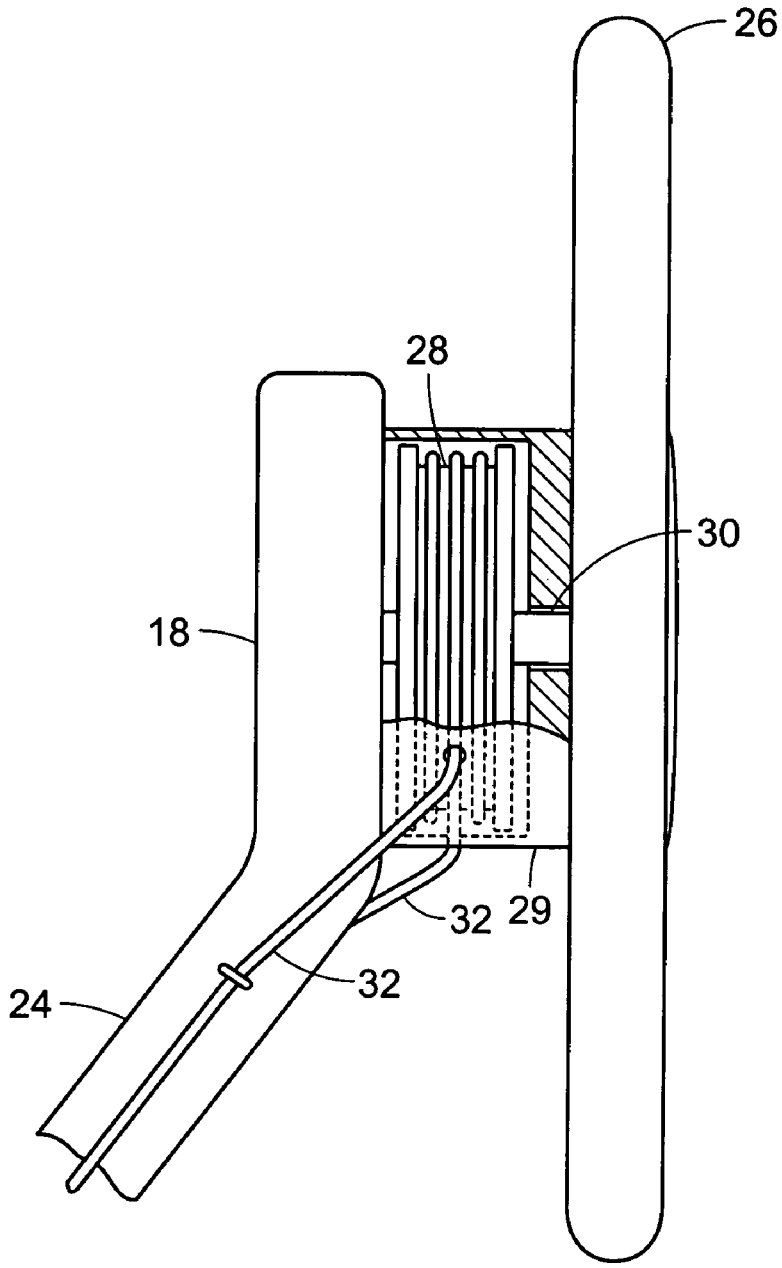
FIG. 2 is an exploded view of the steering wheel of the push toy of the present invention, having a steering mechanism including a reel and pin for propelling the push toy forward.

FIGS. 1 and 2 illustrate the push toy 10 having a steering wheel 26. The steering wheel 26 includes a steering mechanism. The steering mechanism has a turning shaft or reel 28, a reel cover 29, a pin 30, a knob 36, and a pair of eyes 38. The steering wheel 26 is rigidly attached to the reel cover 29 and reel 28, which is coupled to the top end 24 of the bar 18. The reel cover 29 houses the reel 28 which controls the steering of the push toy 10. The pin 30 extends outwardly from the steering wheel 26 and connects to the reel 28. The steering wheel 26 is rotatably connected to the reel 28 about the pin 30. The eyes 38 are each attached to the axel 14, midway between the opposite ends 16 of the axel 14 and the bar 18. The steering mechanism also has one continuous thread 32, preferably nylon, having two free ends 34. The thread 32 loops around the reel 28 within the reel cover 29 for a plurality of turns, including crisscrossing around the knob 36 and allowing the free ends 34 of the thread 32 to each attach through one eye 38 and knot thereto. A plurality of hooks 31 spaced apart along the bar 18, hold the thread 32 in position along the bar 18.

A selective rotation of the steering wheel 26 effectively causes the reel 28 to pull the thread 32 in one direction or the other, thereby applying a torque to the axel 14, causing it to rotate relative to the steering wheel 26 and thereby redirect the direction of the wheels 12 of the push toy 10. The reel 28 may also include a spring-loaded retracting mechanism for allowing the thread 32 to automatically coil therein when slack in the thread 32 is created from turning in one direction or another, thereby helping to steer the push toy 10 in one direction or the other. The steering mechanism allows the push toy 10 to turn corners with precision and thereby sharpens hand-eye coordination of a child.

Figure 3:
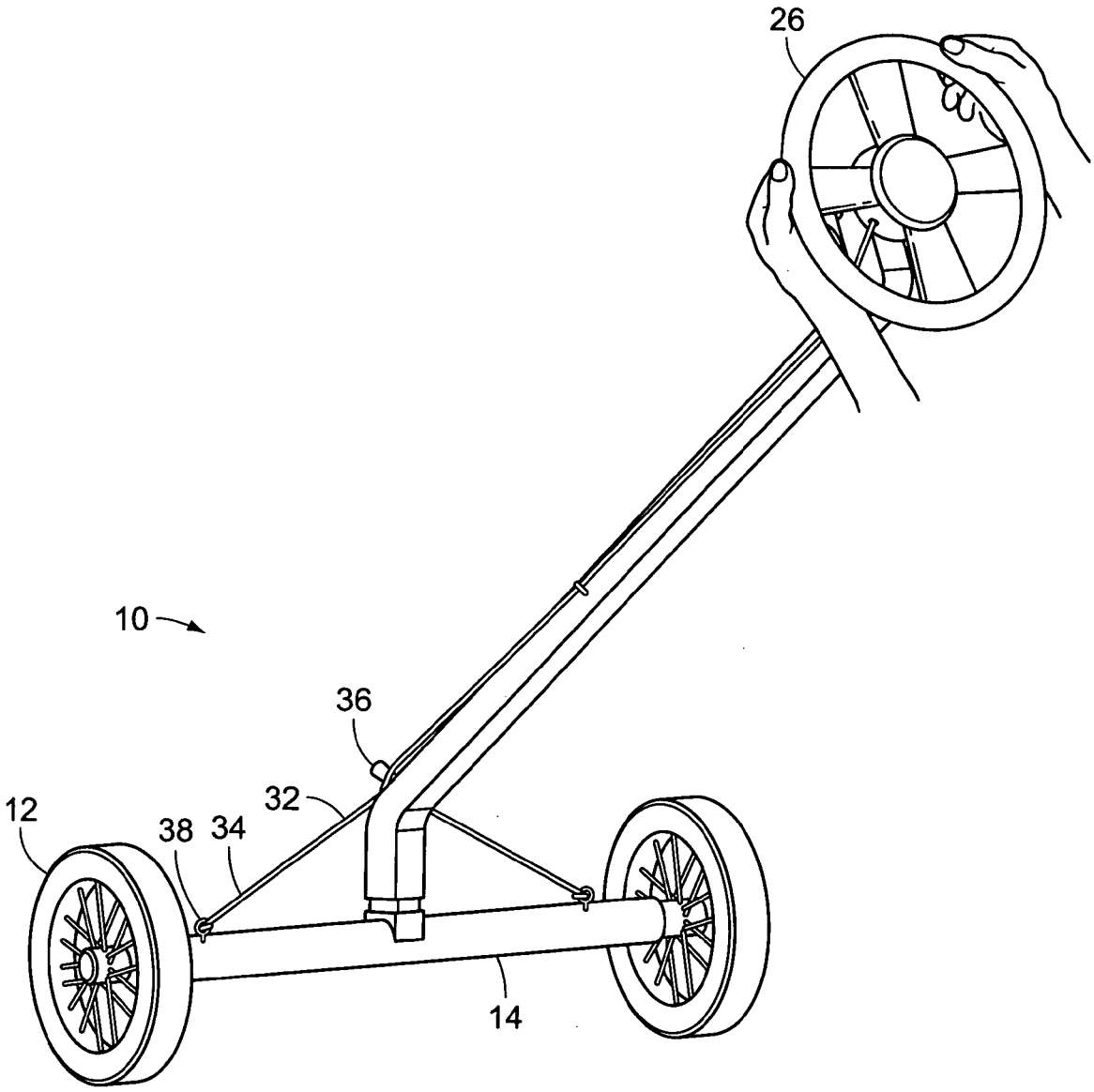
FIG. 3 is a diagrammatic perspective view of the push toy of the present invention in use for providing children with hours of fun-filled amusement.

FIG. 3 illustrates the push toy 10 in use by a child. In use, the child pulls the free ends 34 of the thread 32 out from the reel, thereby unwinding the thread 32 from the reel 28, and crisscrossing the thread 32 around the knob 36 and tying each free end 34 to one of the eyes 38. Next, the child grips the steering wheel 26 and pushes the push toy 10 forward. The child creates a forward motion by pushing the push toy 10 and together as the thread 32 retracts within the spring-loaded retracting mechanism of the reel, propels the push toy 10 forward. By turning the steering wheel 26 the push toy 10 is navigated to turn left or right, with the axel 14 rotating the wheels 12 in the direction indicated by the child. The child may use the push toy 10 on their own or with a group of other friends in order to stage spirited races.

In conclusion, herein is presented a push toy for providing children with hours of fun-filled amusement. The invention is illustrated by example in the drawing figures, and throughout the written description. It should be understood that numerous variations are possible, while adhering to the inventive concept. Such variations are contemplated as being a part of the present invention.

What is claimed is:

1. A push toy for providing children with hours of fun-filled amusement, comprising:

an axel having opposite ends;

a pair of wheels rotatably mounted to the opposite ends of the axel for moving the push toy in one direction or the other;

a bar substantially elongated and hollow, having a bottom end and a top end;

a pivoting joint centrally located on the axel and extending upwardly therefrom, for sliding within the hollow bottom end of the bar;

a steering wheel having a steering mechanism, the steering mechanism having a reel, a reel cover, a pin, a knob, and a pair of eyes, the steering wheel being rigidly attached to the reel cover and reel, which is coupled to the top end of the bar, the reel being housed within the reel cover for controlling the steering of the push toy, the pin being mounted to the steering wheel and extending outwardly therefrom to connect to the reel, the steering wheel being rotatably connected to the reel about the pin, the eyes being each attached to the axel, midway between the opposite ends of the axel and the bar, the steering mechanism having one continuous thread having two free ends for looping around the reel within the reel cover for a plurality of turns, including criss-crossing around the knob and allowing the free ends to each attach through one eye and knot thereto; and a plurality of hooks spaced apart along the bar for holding the thread in position therealong.

2. A push toy for providing children with hours of fun-filled amusement, comprising:

an axel having opposite ends;

a pair of wheels rotatably mounted to the opposite ends of the axel for moving the push toy in one direction or the other;

a bar substantially elongated and hollow, having a bottom end and a top end;

in a pivoting joint centrally located on the axel and extending upwardly therefrom, for sliding within the hollow bottom end of the bar; and a steering wheel having a steering mechanism, the steering mechanism having a reel a reel cover and a pin, the steering wheel being rigidly attached to the reel which is coupled to the top end of the bar, the pin being mounted to the steering wheel and extending outwardly therefrom to connect to the reel, the steering wheel being rotatably connected about the pin, the steering mechanism having one continuous thread having two free ends for looping around the reel within the reel cover.

3. The push toy of claim 2, wherein the reel is housed within the reel cover also rigidly attached to the steering wheel.

4. The push toy of claim 3, further comprising a pair of eyes, which are each attached to the axel, midway between the opposite ends of the axel and the bar, and allow the free ends of the thread to each attach through one eye and knot thereto.

5. The push toy of claim 4, further comprising a knob for allowing the thread to crisscross therearound.

6. The push toy of claim 5, further comprising a plurality of hooks spaced apart along the bar for holding the thread in position therealong.

7. A method of using a push toy by a child, having an axel having opposite ends, a pair of wheels rotatably mounted to the opposite ends of the axel, a bar extending upwardly from the axel, a steering wheel attached to the bar, the steering wheel having a steering mechanism, having a thread having two free ends, a reel, a reel cover a knob, and a pair of eyes, the steps comprising:

setting up the steering mechanism, by pulling the free ends of the thread out from the reel, thereby unwinding the thread from the reel, and crisscrossing the thread around the knob and tying each free end to one of the eyes; and propelling the push toy forward, by gripping the steering wheel and redirecting the direction of the wheels by rotating the steering wheel in one direction or the other, the reel thereby pulling the thread in one direction or the other and applying torque to the axel by having it rotate relative to the direction indicated by the child moving the steering wheel.

* * * * *